US006338389B1

(12) United States Patent
Chang

(10) Patent No.: US 6,338,389 B1
(45) Date of Patent: Jan. 15, 2002

(54) AIR OUTLET REGULATING MECHANISM FOR PNEUMATIC TOOL

(76) Inventor: An-Mei Chang, 7F-10, No. 143, Bo-An Street, Taichung City (TW)

( * ) Notice: Subject to any disclaimer, the term of this patent is extended or adjusted under 35 U.S.C. 154(b) by 0 days.

(21) Appl. No.: 09/800,728

(22) Filed: Mar. 8, 2001

(51) Int. Cl.[7] ..... B25B 19/00; B25B 45/04

(52) U.S. Cl. ..... 173/169; 173/170; 173/DIG. 2

(58) Field of Search ..... 173/168, 169, 173/170, 93, 93.5, 93.6, 206, DIG. 2, 221

(56) References Cited

U.S. PATENT DOCUMENTS 4,773,487 A * 9/1988 Ringer ..... 173/170
5,377,769 A * 1/1995 Hasuo et al. ..... 173/169
5,417,294 A * 5/1995 Suher ..... 173/168
5,775,439 A * 7/1998 Biek ..... 173/93.5
5,901,794 A * 5/1999 Schoeps et al. ..... 173/169
6,047,780 A * 4/2000 Lin ..... 173/168
6,161,628 A * 12/2000 Liu ..... 173/206

* cited by examiner

*Primary Examiner*—Scott A. Smith
(74) *Attorney, Agent, or Firm*—Rosenberg, Klein & Lee

(57) ABSTRACT

An air outlet regulating mechanism for a pneumatic tool includes a long vertical and a short horizontal air-out passage provided in a handle and a body of the pneumatic tool, respectively, and a regulating valve mounted in the pneumatic valve at a convergence point of the two air-out passages and a body air-out passage typically provided in the pneumatic tool. The regulating valve includes a knob accessible from outside of the pneumatic tool and a long stopper movable between a first and a second position through turning of the knob. The long stopper in the first position fully blocks the vertical air-out passage for air in the pneumatic tool in operation to discharge via the short horizontal air-out passage to increase the torque force of the pneumatic tool. And, The long stopper in the second position fully blocks the horizontal air-out passage for air in the pneumatic tool in operation to discharge via the long vertical air-out passage to lower the noise produced during discharging of air from the pneumatic tool.

2 Claims, 4 Drawing Sheets

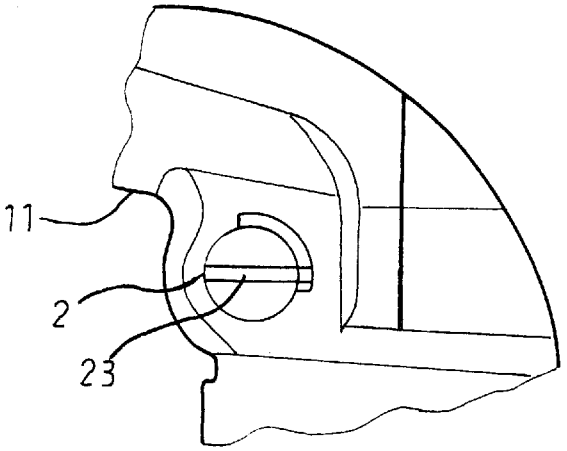
FIG.4A
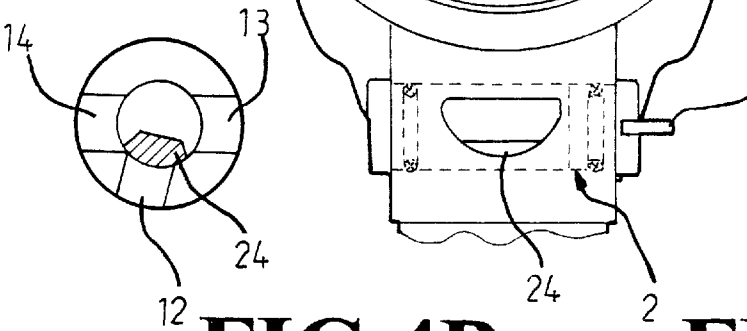
FIG.4B
FIG.4C
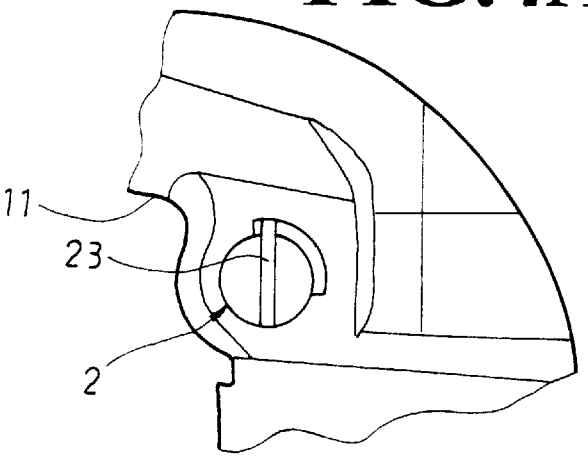
FIG.5A
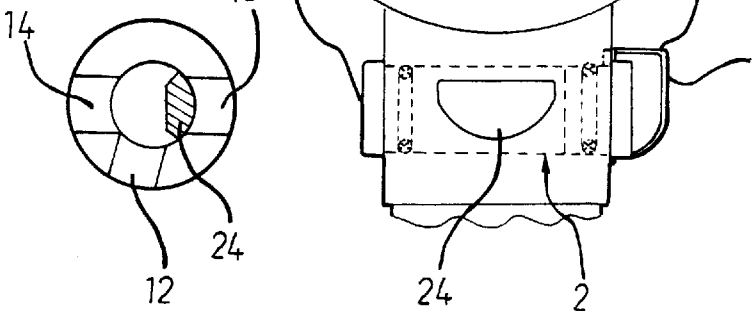
FIG.5B
FIG.5C

AIR OUTLET REGULATING MECHANISM FOR PNEUMATIC TOOL

BACKGROUND OF THE INVENTION

The present invention relates to an air outlet regulating mechanism for pneumatic tool, and more particularly to a mechanism for regulating the passage via which air is discharged from the pneumatic tool, so that either an increased torque force or a reduced air discharge noise of the pneumatic tool could be obtained depending on actual needs.

In a conventional pneumatic tool, there is an air outlet hole provided at a lower part of a body of the tool, so that air could be discharged from the air outlet hole when the pneumatic tool is in operation. When the air is discharged from the air outlet hole, a considerably large explosive sound (or burst noise) is produced. Such explosive sound forms a serious noise when the pneumatic tool is used indoors. A means to reduce the noise is to provide an extended air-out passage in the pneumatic tool. Such extended air-out passage, however, reduces a torque force of the pneumatic tool and is therefore not ideal for use.

SUMMARY OF THE INVENTION

A primary object of the present invention is to provide an air outlet regulating mechanism for a pneumatic tool, so that air in the pneumatic tool could be selectively discharged via different passages to either increase the torque force of the tool or reduce an air discharge noise thereof, depending on actual needs in different working sites.

To achieve the above and other objects, the air outlet regulating mechanism of the present invention mainly includes a long vertical and a short horizontal air-out passage provided in a handle and a body of the pneumatic tool, respectively, and a regulating valve mounted in the pneumatic valve at a convergence point of the two air-out passages and a body air-out passage typically provided in the pneumatic tool. The regulating valve includes a knob accessible from outside of the pneumatic tool and a long stopper movable between a first and a second position through turning of the knob. The long stopper in the first position fully blocks the vertical air-out passage for air in the pneumatic tool in operation to discharge via the short horizontal air-out passage to increase the torque force of the pneumatic tool. And, The long stopper in the second position fully blocks the horizontal air-out passage for air in the pneumatic tool in operation to discharge via the long vertical air-out passage to lower the noise produced during discharging air from the pneumatic tool.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein

FIG. 4A is a fragmentary front view of the pneumatic tool of FIG. 1 with the regulating valve in the first position;

FIG. 4B is a front view of the regulating valve of the present invention in the first position;

FIG. 4C is a fragmentary left side view of the pneumatic tool of FIG. 1 with the regulating valve in the first position;

FIG. 5A is a fragmentary front view of the pneumatic tool of FIG. 1 with the regulating valve in the second position;

FIG. 5B is a front view of the regulating valve of the present invention in the second position; and FIG. 5C is a fragmentary left side view of the pneumatic tool of FIG. 1 with the regulating valve in the second position.

DETAILED DESCRIPTION OF THE PREFERRED EMBODIMENTS

Figure 1:
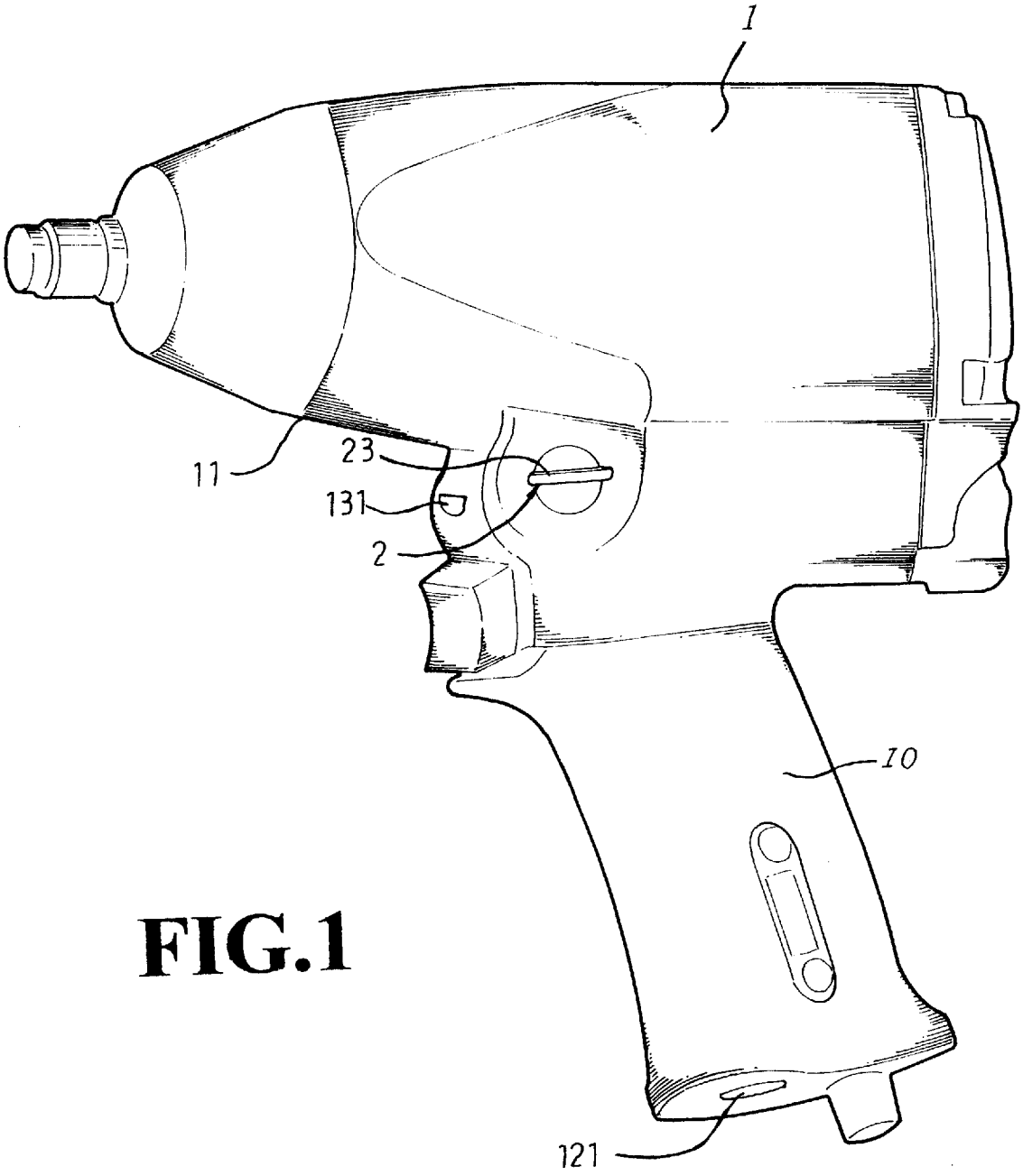
FIG. 1 is a perspective of a pneumatic tool including an air outlet regulating mechanism of the present invention.
Figure 2:
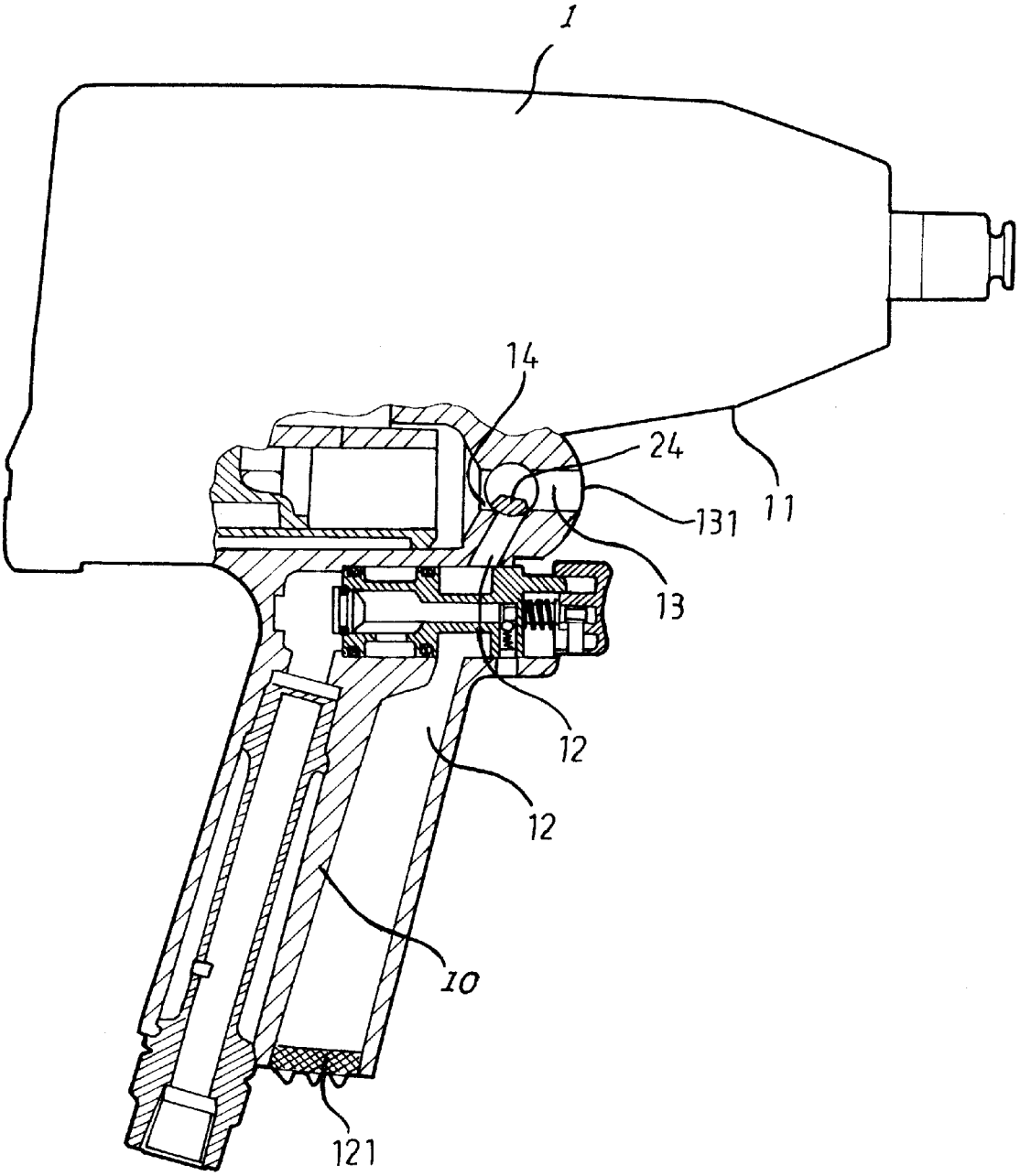
FIG. 2 is a partially sectioned view of the pneumatic tool of FIG. 1 showing the location of the air outlet regulating mechanism in the pneumatic tool.

Please refer to FIGS. 1 and 2 in which a pneumatic tool 1 including an air outlet regulating mechanism of the present invention is shown. The air outlet regulating mechanism 1 mainly includes a vertical air-out passage 12 provided in a handle portion 10 of the pneumatic tool 1 with an air outlet 121 of the air-out passage 12 provided at a lower end of the handle portion 10, a horizontal air-out passage 13 that is shorter than the vertical air-out passage 12 and is provided in a lower front area of a body portion 11 of the pneumatic tool 1 with an air outlet 131 of the air-out passage 13 provided at a lower front of the body portion 11, and a regulating valve 2 mounted in the pneumatic tool 1 at a convergence point of the vertical and the horizontal air-out passages 12, 13 as well as a body air-out passage 14 provided in the body portion 11.

Figure 3B:
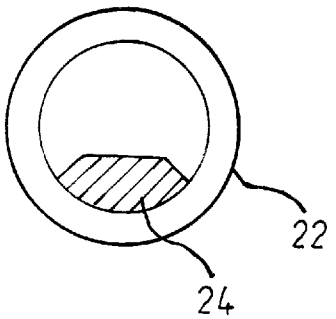
FIG. 3B is a cross sectional view taken on line A–A' of FIG. 3A.
Figure 3D:
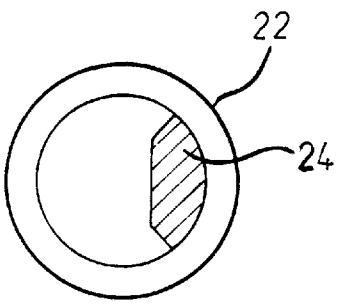
FIG. 3D is a cross sectional view taken on line B–B' of FIG. 3C.
Figure 3A:
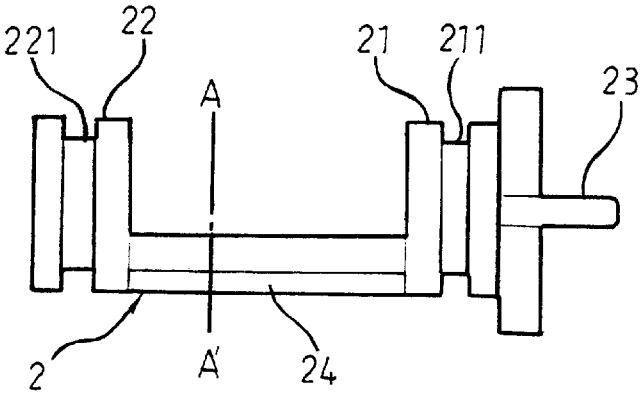
FIG. 3A is a side view of a regulating valve of the air outlet regulating mechanism of the present invention in a first position.
Figure 3C:
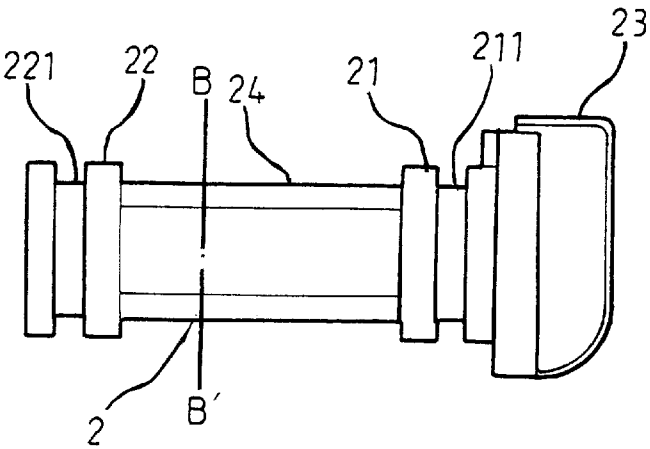
FIG. 3C is a side view of the regulating valve of the air outlet regulating mechanism of the present invention in a second position.

Please refer to FIG. 3A that is a side view of the regulating valve 2. As shown, the regulating valve 2 includes two symmetrical disc portions 21 and 22, a knob portion 23 connected to the disc portion 21 that is located closer to an outer side of the pneumatic tool 1 than the other disc portion 22, and a long stopper 24 having a substantially semicircular cross section and extended between the two disc portions 21, 22 to connect them to one another. Both the disc portions 21 and 22 have a diameter-reduced middle portion 211, 221, at where the regulating valve 2 is fixedly mounted in the pneumatic tool 1 at the convergence point of the vertical, the horizontal, and the body air-out passages 12, 13 and 14, respectively. The knob portion 23 is rotatably located outside the body portion 11 of the pneumatic tool 1. By turning the knob portion 23, it is possible to move the long stopper 24 between a first and a second position. FIG. 3B is a cross sectional view taken on line A–A' of FIG. 3A, showing the long stopper 24 in the first position. FIG. 3C is another side view of the regulating valve 2 with the knob portion 23 being turned to locate the long stopper 24 in the second position. And, FIG. 3*d* is a cross sectional view taken on line B–B' of FIG. 3C, showing the long stopper 24 in the second position.

When the pneumatic tool 1 is used outdoors or in a place at where noise from the pneumatic tool 1 in operation is not a consideration, an operator may turn the knob portion 23 to a horizontal position as shown in FIG. 4A, so as to locate the long stopper 24 in the first position as shown in FIGS. 4B and 4C. The long stopper 24 in the first position fully blocks an inner end of the vertical air-out passage 12, so that air from the body air-out passage 14 in the pneumatic tool 1 is guided into the horizontal air-out passage 13 and discharged via the air outlet 131. Since the horizontal air-out passage 13 is short, discharge of air via the horizontal air-out passage 13 may advantageously increase a torque force of the pneumatic tool 1.

When the pneumatic tool 1 is used indoors or in a closed place at where noise from the pneumatic tool 1 in operation is a consideration, the operator may turn the knob portion 23 to a vertical position as shown in FIG. 5A, so as to locate the long stopper 24 in the second position as shown in FIGS. 5B and 5C. The long stopper 24 in the second position fully blocks an inner end of the horizontal air-out passage 13, so that air from the body air-out passage 14 in the pneumatic tool 1 is guided into the vertical air-out passage 12 and discharged via the air outlet 121. Since the vertical air-out passage 12 is long, discharge of air via the vertical air-out passage 12 requires extended time that advantageously lowers the noise produced during discharge of air but disadvantageously reduces the torque force of the pneumatic tool 1. Nevertheless, the pneumatic tool 1 could still work normally.

With the vertical and the horizontal air-out passages 12, 13 provided in the handle portion 10 and the body portion 11 of the pneumatic tool 1, respectively, and the regulating valve 2 provided in the pneumatic tool 1 at the convergence point of the vertical and the horizontal air-out passages 12, 13 as well as the body air-out passage 14, air in the pneumatic tool 1 in operation could be selectively discharged via the vertical or the horizontal air-out passage 12 or 13 through turning the regulating valve 2, so as to either lower the noise during air discharging or increase the torque force of the pneumatic tool 1, depending on different considerations in the working sites.

What is claimed is:

1. An air outlet regulating mechanism for pneumatic tool having a handle portion and a body portion, comprising a vertical air-out passage provided in said handle portion, a horizontal air-out passage provided in a lower front area of said body portion, and a regulating valve mounted in said pneumatic valve at a convergence point of said vertical and said horizontal air-out passages as well as a body air-out passage typically provided in said body portion;

said vertical air-out passage having extended length to enable extended air discharge time and therefore lowered air discharge noise, and said horizontal air-out passage being shorter than said vertical air-out passage to enable increased torque force of said pneumatic tool; and said regulating valve including two symmetrical disc portions, a knob portion connected to one of said two disc portions that is located closer to an outer side of said pneumatic tool than the other said disc portion, and a long stopper having a substantially semicircular cross section and extended between said two disc portions to connect them to one another; and said knob portion being rotatably located outside said body portion of said pneumatic tool, so that an operator may turn said knob portion to move said long stopper between a first and a second position; said long stopper in said first position being adapted to block said vertical air-out passage for air from said body air-out passage to discharge from said pneumatic tool via said horizontal air-out passage without reducing the torque force of said pneumatic tool, and said long stopper in said second position being adapted to block said horizontal air-out passage for air from said body air-out passage to discharge from said pneumatic tool via said vertical air-out passage to lower noise generated during discharging of air from said pneumatic tool.

2. An air outlet regulating mechanism for pneumatic tool as claimed in claim 1, wherein both said two disc portions have a diameter-reduced middle portion at where said regulating valve is fixedly connected to said pneumatic tool at said convergence point of said vertical, said horizontal, and said body air-out passages.

* * * * *